US005182924A

United States Patent [19]

Trulaske, Sr.

[11] Patent Number: 5,182,924

[45] Date of Patent: Feb. 2, 1993

[54] REFRIGERATOR UNIT FOR FOOD PRODUCTS

[75] Inventor: Robert J. Trulaske, Sr., Frontenac, Mo.

[73] Assignee: True Food Service Equipment, Inc., O'Fallon, Mo.

[21] Appl. No.: 912,025

[22] Filed: Jul. 9, 1992

Related U.S. Application Data

[63] Continuation of Ser. No. 713,635, Jun. 10, 1991, abandoned, which is a continuation of Ser. No. 416,549, Oct. 3, 1989, abandoned.

[51] Int. Cl.[5] ..... F25B 49/00; A47F 3/04

[52] U.S. Cl. ..... 62/255; 62/258

[58] Field of Search ..... 62/246, 249, 254, 255, 62/258

[56] References Cited

U.S. PATENT DOCUMENTS

| | | | |
|---|---|---|---|
| 2,786,337 | 3/1957 | Spring | 62/258 |
| 2,886,395 | 5/1959 | Cahn | 62/258 X |
| 2,938,363 | 5/1960 | Dickinson et al. | 62/249 |
| 3,004,400 | 10/1961 | Mann et al. | 62/419 X |
| 3,009,338 | 11/1961 | Dobbie | 62/419 |
| 3,043,114 | 7/1962 | O'Connell | 62/419 X |
| 3,103,797 | 9/1963 | Harley, Jr. | 62/419 |
| 3,364,696 | 1/1968 | Maxwell | 62/419 X |
| 4,685,311 | 8/1987 | Rostelli | 62/255 X |
| 4,802,340 | 2/1989 | Johnson | 62/255 X |

OTHER PUBLICATIONS

Air Conditioning and Refrigerating News, Jul. 26, 1939, pp. 18 & 19 "Installation and Servicing of Accessory Fixtures Multiplexed with Fountains", A. Black and D. C. Seitz.

*Primary Examiner*—William E. Tapolcai
*Attorney, Agent, or Firm*—Cohn, Powell & Hind

[57] ABSTRACT

This refrigerator unit (10) for storing and serving salads and sandwiches includes an insulated cabinet (12) having a top wall (26) with a front portion (28) providing a cutting board (30) and a rear portion (32) carrying multiple rows of removable food product pans (36) extending into the cabinet. The unit includes a cover assembly (16) providing a fixed, foam-insulated hood (38) and a foam-insulated cover (40) pivoted to the hood for movement from a position enclosing the pan area to a position affording access to the pan area. The inside of the cabinet is provided with a forced air refrigeration system (70) which includes a fan (78) delivering air into a passage (94) which houses an evaporator coil (82) and has an upper end opening (98) for delivering cooled air onto and between the pans.

6 Claims, 2 Drawing Sheets

REFRIGERATOR UNIT FOR FOOD PRODUCTS

This is a continuation of copending application(s) Ser. No. 07/713,635 filed on Jun. 10, 1991 abandoned, which is a continuation of Ser. No. 07/416,549 Oct. 3, 1989, abandoned.

BACKGROUND OF THE INVENTION

This invention generally relates to a refrigerator unit for food products and particularly to a salad/sandwich preparation unit having an improved insulated cover and refrigeration system.

Salad/sandwich refrigerator units having a storage cabinet with a top including a counter at the front and an enclosable pan area for food products such as condiments, sliced tomatoes, sliced lettuce, and the like, have been manufactured by several companies for many years and are commonly found in grocery stores and restaurants. While these units are generally effective for their intended purpose they suffer from two disadvantages. One of these is that the cover assembly, which is frequently of stainless steel, is not efficient in maintaining cool temperatures within the cabinet and also permits annoying condensation to form on the upper surface of the cover. Another disadvantage is that the refrigeration system within the cabinet is designed primarily to cool products stored within the cabinet and does satisfactorily cool the pans in which the prepared salad/sandwich products are kept.

This invention solves these and other problems in a manner not revealed in the known prior art.

SUMMARY OF THE INVENTION

This salad/sandwich preparation refrigerator unit provides the advantage of a cover assembly which is insulated to maintain cooler temperatures within the cabinet and to minimize the formation of condensation on the stainless steel outer surface of the cover.

The unit also provides the advantage of a self-contained refrigeration system in the cabinet which is arranged to distribute cool air efficiently to the prepared food product pans and maintain the contents of the pans in a fresh condition.

It is an aspect of this invention to provide a refrigerator unit for food products including a cabinet having opposed sidewalls, a bottom wall, a rear wall, at least one front door and a top wall, the top wall having a front portion providing a work area and a rear portion providing a pan area and having a plurality of pan-receiving openings; a cover assembly for the rear portion of the top wall including a fixed portion, and a movable cover having an insulated top wall, said cover being operatively pivotally attached to the fixed portion to move from a closed position, providing at least part of an insulated enclosure for the pan area, to an open position affording access to the pan area; a plurality of removable pans insertable within the pan-receiving openings, each having an upper portion operatively carried by the rear portion of the cabinet top wall and a depending lower portion including a bottom wall, said lower portion extending into the interior of the cabinet, and forced-air refrigeration means within the cabinet for cooling the interior of the cabinet and the pans.

It is another aspect of this invention to provide a cover assembly including a fixed hood having an insulated back wall and an insulated top wall and opposed sidewalls and a cover having an insulated top wall and opposed sidewalls.

It is yet another aspect of this invention to provide that the insulated movable cover top wall includes an outer portion, a foam core and an inner liner and another aspect to provide that the insulated hood back wall and top wall each include an outer portion, a foam core and an inner liner.

It is still another aspect of this invention to provide that the refrigeration means includes a fan and means directing cooling air onto the pans above the bottom wall thereof.

One aspect of tis invention is to provide that the refrigeration system includes a fan motor and passage means adjacent the cabinet rear wall and having exit means disposed above the bottom wall of the pans for directing cooling air onto the pans above the bottom wall thereof.

Another aspect of this invention is that the refrigeration system includes means carrying the fan with the fan blade facing the rear wall of the cabinet and the passage means includes interior wall means spaced from the rear wall of the cabinet and including a lower portion disposed below the upper portion of the fan and an upper portion disposed above the upper portion of the fan and spaced from the cabinet top wall to define an elongate opening directing the cooling air onto and between the pans, and the refrigeration system includes an evaporator coil disposed between the cabinet rear wall and the passage means upper wall portion.

Yet another aspect of this invention is to provide that the passage means upper wall portion includes an elongate lip turned inwardly of the passage means and cooperating with the cabinet top wall rear portion to direct the cooling air.

Still another aspect of this invention is to provide two rows of pans, the pans being spaced to form passage means therebetween directing air through the first row of pans onto the second row of pans.

It is an aspect of this invention to provide a salad and sandwich refrigerator unit which is relatively inexpensive and simple to manufacture and is particularly effective in operation.

DESCRIPTION OF THE PREFERRED EMBODIMENT

Figure 1:
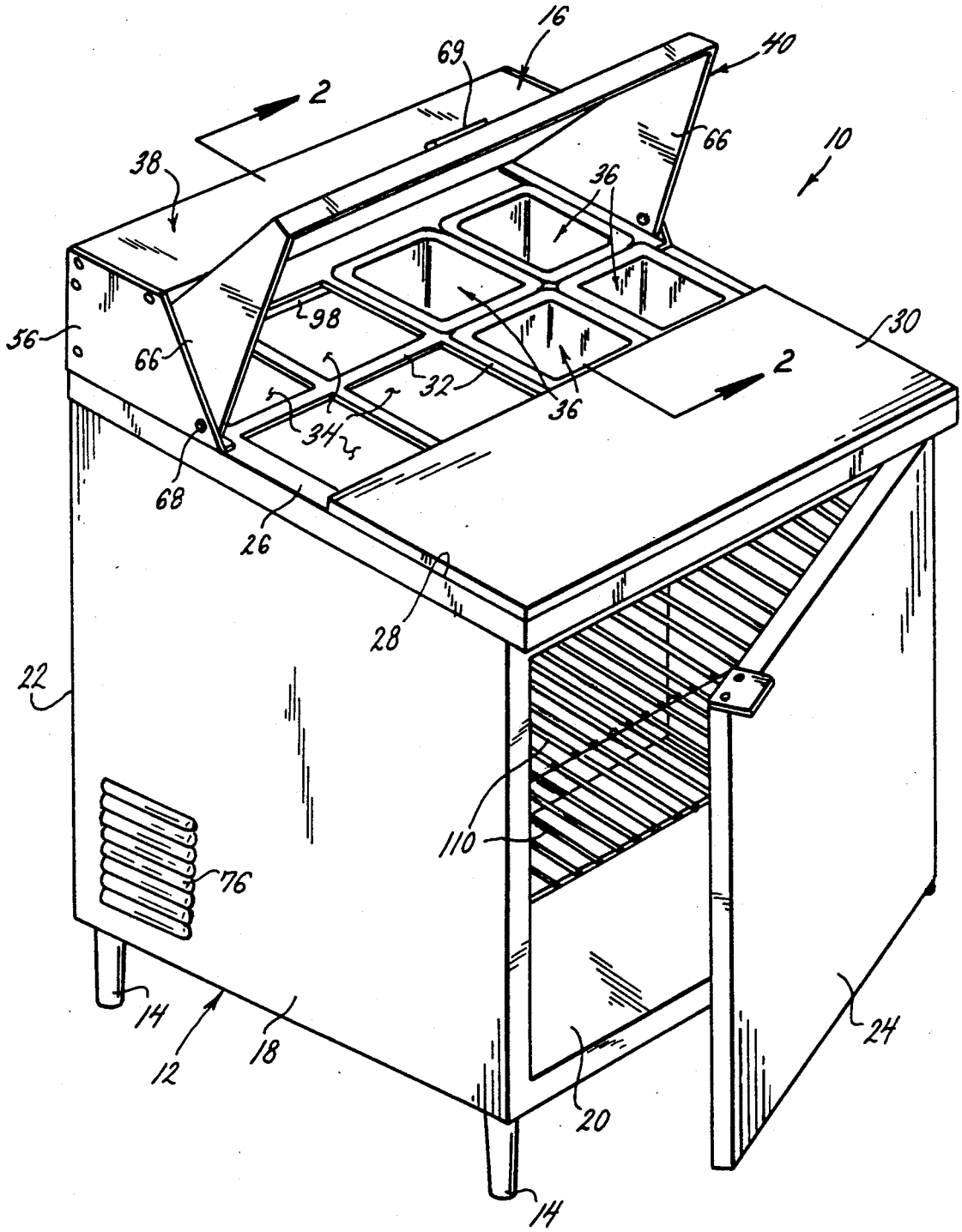
FIG. 1 is a perspective view of the salad/sandwich refrigerator unit.

Referring now by reference numerals to the drawings and first to FIG. 1, it will be understood that the refrigerator unit 10 includes a cabinet 12, supported on legs 14 and having an insulated cover assembly generally indicated by numeral 16. The cabinet 10 includes opposed insulated sidewalls 18, an insulated bottom wall 20, a rear wall 22, a hingedly attached insulated front door 24 and a top wall 26.

The cabinet top wall 26 includes a front portion 28 providing a base for a work area in the form of a removable cutting board 30 of high density polyurethane or the like and a rear portion 32 having, in the embodiment shown, two rows of four (4) openings 34, each receiving an insert pan 36 of clear polycarbonate, or the like which extends into the interior of the cabinet 12. The cover assembly 16 includes a fixed hood 38 and a pivoted cover 40 which is movable from a closed position, in which it cooperates with the hood 38 to provide an insulated enclosure for the pan area, to an open position affording access to the pan area.

Figure 2:
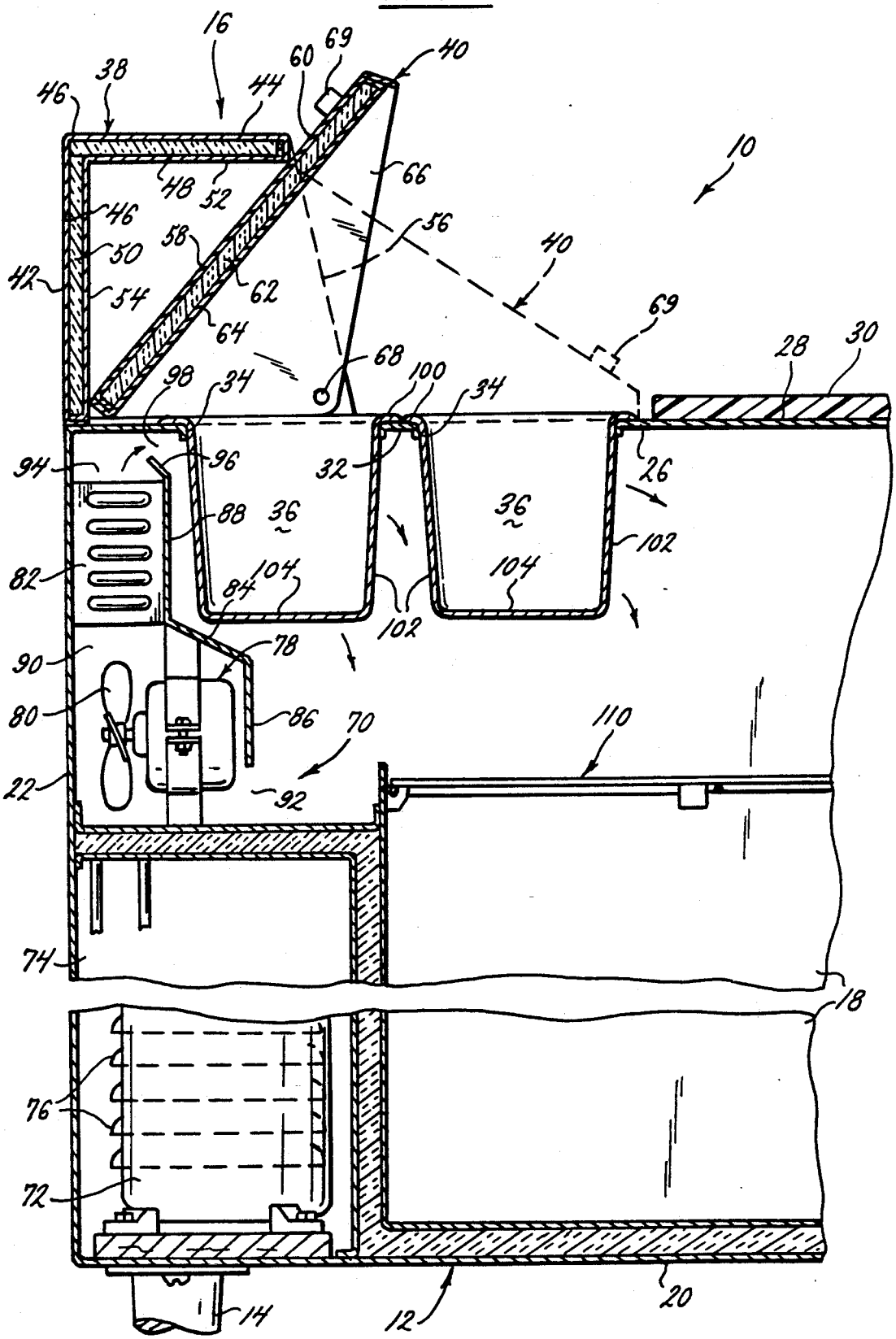
FIG. 2 is a cross-sectional view taken through line 2—2 of FIG. 1.

As best shown in FIG. 2 the fixed hood 38 includes a back wall 42 and integral upper wall 44. Both walls are formed from an ell-shaped outer wall portion 46, preformed sheets of insulating foam 48 and 50 providing a core, and liners 52 and 54. Opposed sidewalls 56 of generally trapezoidal configuration are attached to the back wall 42 and the upper wall 44, as by fasteners. The hood 38, as a whole, is removably attached to the cabinet 12 as by fasteners (not shown).

The movable cover 40 includes an upper wall 58, which is formed from an outer wall portion 60, a preformed sheet of insulating foam 62 and a liner 64. Opposed sidewalls 66 of generally triangular configuration are attached to the upper wall 58, as by fasteners. The movable cover 40 is pivotally attached to the fixed hood 38 by opposed pivot pins 68 provided between associated hood and cover sidewalls 56 and 66 and a handle 69 is provided to swing the cover between the closed position shown in phantom outline into the free standing open position shown in full lines in FIG. 2.

As also shown in FIG. 2 the refrigerator unit 10 includes a forced-air refrigeration system generally indicated by numeral 70. The refrigeration system includes a compressor 72 disposed within an insulated compartment 74 having sidewall vents 76; an electric fan 78 seated on the upper wall of the compartment 74, and having the fan blade 80 facing the cabinet rear wall 22, and an evaporator 82. An interior wall 84 extends between cabinet sidewalls 18 and attached thereto as by fasteners (not shown). The evaporator 82 is attached between the interior wall 84 and the rear wall 22. The interior wall 84 performs an important function in that it defines a passage means for directing cool air blown from the fan blade 80 into the upper part of the cabinet in the vicinity of the insert pans 36. To this end, the wall 84 includes a lower portion 86 and an upper portion 88 including an inclined connecting portion. The lower portion 86 defines a fan compartment 90 and is spaced from the compressor compartment 74 to provide an elongate inlet opening 92 through which air is drawn by the fan blade 80 into the fan compartment 90. The upper portion 86 defines a passage means 94 and includes an inturned lip 96 which is spaced from the cabinet top wall rear portion 32 to provide an elongate outlet opening 98 through which air is directed onto the pans 36 and through the passageways defined by adjacent pans 36 and by cooperation between the pans and the interior wall 84. The pans 36 each include an upper peripheral lip 100 by which they engage the margins of openings 34 so that the pan sidewalls 102 and bottom wall 104 are disposed in depending relation from the top wall rear portion 32. The elongate passage opening 98 is disposed above the pan bottom wall 104 so that air is directed onto and between the pans 36 above the bottom wall to flow downwardly tending to maintain the pans in a cool condition and circulate the air efficiently to the pans 36 and also to food products stored on the cabinet shelves 110. When the cover 40 is both closed and open the cooling air is directed into the vicinity of the pans 36 and food product contained therein. Because of the insulation provided in the hood 38 and cover 40 annoying condensation on the outer portions of these members is virtually eliminated.

In the embodiment shown the insulated cabinet sidewalls 18, bottom wall 20 and door 24 are formed from stainless steel outer walls with aluminum liners and foamed-in-place high density polyurethane insulation but other material could be utilized. Likewise, the hood and cover are preferrably formed from stainless steel outer walls, aluminum liners but are provided with sheet polyurethane cores.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. A refrigerator unit for food products comprising:

(a) a cabinet including opposed sidewalls, a bottom wall, a rear wall, at least one front door and a top wall, the top wall having a front portion providing a work area and a rear portion providing a pan area and having a plurality of pan-receiving openings, (b) a cover assembly for the rear portion of the top wall including a fixed portion and a movable cover, said cover being operatively pivotally attached to said fixed portion to move from a closed position, providing at least part of an enclosure for the pan area, to an open position affording access to the pan area, (c) a plurality of removable pans insertable within the pan-receiving openings, each having an upper portion operatively carried by the rear portion of the cabinet top wall and a depending lower portion including sidewalls and a bottom wall, said lower portion extending into the interior of the cabinet, and (d) a forced air refrigeration system within the cabinet for cooling the interior of the cabinet and the pans, said system including a fan and an evaporator adjacent the cabinet rear wall, the fan being adapted to force air through the evaporator for said cooling, and passage means between the fan and the pans, the passage means adapted to confine to the evaporator air drawn in by the fan, and to direct cooled air blown from the evaporator onto and between the pans, (e) the refrigeration system including means carrying the fan with the fan blade facing the rear wall of the cabinet and the passage means includes interior wall means spaced from the rear wall of the cabinet and including a lower portion disposed below the upper portion of the fan and an upper portion disposed above the upper portion of the fan and spaced from the cabinet top wall to define an elongate opening directing cooling air onto and between the pans, the refrigeration system including an evaporator coil disposed between the cabinet rear wall and the passage means upper wall portion, (f) the passage means upper wall portion including an elongate lip turned inwardly of the passage means and cooperating with the cabinet top wall rear portion to direct the cooling air.

2. A refrigerator unit as defined in claim 1, in which:

(g) two rows of pans are provided, the pans being spaced to form passage means therebetween directing air through the first row of pans onto the second row of pans.

3. A refrigerator unit for food products comprising:

(a) a refrigerated cabinet having a front top portion providing a work area and a rear top portion having a plurality of pan-receiving openings, (b) a cover assembly for the rear top portion including a pivotally attached movable cover providing a closure for the pan area, (c) a plurality of removable pans insertable within the pan-receiving openings such that lower portions of pans therein extend into the refrigerated cabinet, (d) interior wall means spaced from a wall of the cabinet, the wall means including a lower portion and an upper portion providing upper and lower openings to form a vertical passageway between the cabinet wall and the interior wall, (e) a forced air refrigeration system within the cabinet for cooling the interior of the cabinet, said system including:

(1) an evaporator coil disposed in the passageway between the cabinet wall and the interior wall, (2) a fan disposed in the lower opening between the cabinet wall and the lower portion of the interior wall means and adapted to force air through the passageway over the evaporator coil for said cooling, (f) means securing the upper wall portion adjacent at least one pan side to form a channel between the upper wall portion and the pan, and (g) means adapted to divert the forced air so that it flows into said channel, (h) the lower wall portion of the interior wall means being adapted to divert the forced air leaving the channel so that it flows across the bottoms of the pans, (i) wherein the cover assembly for the rear portion of the top wall includes:

1. a fixed hood having an insulated back wall and top wall each including an outer portion, a preformed sheet insulating foam core and an inner liner, and opposed sidewalls, and 2. a movable cover having an insulated top wall including an outer portion, a preformed sheet, insulating foam core and an inner liner and opposed side walls, said sidewalls being operatively connected in pivotal relation to the opposed sidewalls of the hood to move said cover from a closed position cooperating with the hood to provide an insulated enclosure for the pan area, to an open position affording access to the pan area, and (j) the means adapted to divert the forced air into the channel between the wall and the pans being an elongate lip turned inwardly of the passage means and cooperating with the cabinet top wall rear portion to direct the cooling air.

4. A refrigerator unit for food products comprising:

(a) a refrigerated cabinet having a front top portion providing a work area and a rear top portion having a plurality of spaced, pan-receiving openings disposed in a row and having support margins, (b) a plurality of removable pans insertable within the pan-receiving openings the pans having upper lip means, sidewalls and a bottom wall, the lip means being engageable with the support margins such that the sidewalls extend substantially entirely into the refrigerated cabinet, and such that adjacent pans are spaced from each other to define passageways extending for substantially the full depth of the sidewalls, (c) interior wall means spaced from a rear wall of the cabinet, to form a vertical passageway between the cabinet rear wall and the interior wall means, said wall means having an upper portion defining an outlet opening adjacent the pans in the area of the support margins and a lower portion defining an inlet opening, (d) a forced air refrigeration system within the cabinet adapted to cool the interior of the cabinet including an evaporator coil disposed in the passageway, and a forced air fan to force air through the passageway and the outlet opening, said outlet opening directing airflow into and through the passageways defined by adjacent pans to fall substantially unrestrictedly into the cabinet area below the pans.

5. A refrigerator unit as defined in claim 4, in which: the evaporator coil is disposed closely adjacent the outlet opening, and the forced air fan is disposed below the coil.

6. A refrigerator unit as defined in claim 4, in which: the cabinet includes shelves disposed below the pans and receiving air falling from the passageways between the pans.

* * * * *